US006836265B1

(12) United States Patent
Lee et al.

(10) Patent No.: US 6,836,265 B1
(45) Date of Patent: Dec. 28, 2004

(54) LIQUID CRYSTAL DISPLAY PANEL AND ASSOCIATED METHOD FOR DRIVING

(75) Inventors: Hyun Chang Lee, Seoul (KR); Yong Hoon Choi, Kyounggi-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 404 days.

(21) Appl. No.: 09/665,117

(22) Filed: Sep. 20, 2000

(30) Foreign Application Priority Data

Sep. 22, 1999 (KR) ..... P 1999-40985

(51) Int. Cl.[7] ..... G09G 3/36

(52) U.S. Cl. ..... 345/87; 345/55; 345/77; 345/79

(58) Field of Search ..... 345/87, 55, 58, 345/78, 96, 209, 77, 79, 88, 94, 204

(56) References Cited

U.S. PATENT DOCUMENTS

| | | | | | |
|---|---|---|---|---|---|
| 4,800,382 | A | * | 1/1989 | Okada et al. | 345/97 |
| 5,191,450 | A | * | 3/1993 | Yajima et al. | 359/133 |
| 5,233,338 | A | * | 8/1993 | Surguy | 345/88 |
| 5,608,420 | A | * | 3/1997 | Okada | 345/89 |
| 5,619,225 | A | * | 4/1997 | Hashimoto | 345/98 |
| 5,627,556 | A | * | 5/1997 | Kwon et al. | 345/76 |
| 5,670,973 | A | * | 9/1997 | Bassetti, Jr. et al. | 345/58 |
| 5,691,740 | A | * | 11/1997 | Onitsuka et al. | 345/96 |
| 5,796,380 | A | * | 8/1998 | Kurematsu | 345/96 |
| 5,850,216 | A | * | 12/1998 | Kwon | 345/204 |
| 6,104,367 | A | * | 8/2000 | McKnight | 345/94 |
| 6,130,654 | A | * | 10/2000 | Hayashi et al. | 345/63 |
| 6,232,939 | B1 | * | 5/2001 | Saito et al. | 345/93 |
| 6,369,832 | B1 | * | 4/2002 | McKnight | 345/691 |
| 6,498,595 | B1 | * | 12/2002 | Knapp et al. | 345/94 |
| 6,509,887 | B1 | * | 1/2003 | Kondoh et al. | 345/87 |

FOREIGN PATENT DOCUMENTS

| | | | | |
|---|---|---|---|---|
| JP | 5-303076 | * | 11/1993 | G02F/1/133 |
| JP | 405303076 A | * | 11/1993 | |
| JP | 405323903 A | * | 12/1993 | |
| JP | 2001147676 A | * | 5/2001 | |

* cited by examiner

*Primary Examiner*—Albert Decady
*Assistant Examiner*—Fritz Alphonse
(74) *Attorney, Agent, or Firm*—McKenna Long & Aldridge LLP

(57) ABSTRACT

A method of driving a liquid crystal display panel that is adaptive for providing the entire panel with a brightness uniformity. In the method, the scanning direction of the panel is inverted at a desired period, for example, every frame, or within a frame. Accordingly, the average turn-on interval of all of the pixels within the panel becomes equal, so that the brightness of the entire panel can be uniform.

14 Claims, 8 Drawing Sheets

LIQUID CRYSTAL DISPLAY PANEL AND ASSOCIATED METHOD FOR DRIVING

This application claims the benefit of Korean Patent Application No. 1999-40985, filed on Sep. 22, 1999, which is hereby incorporated by reference for all purposes as if fully set forth herein.

BACKGROUND OF THE INVENTION

1. Field of the Invention

The present invention relates to a method of driving a liquid crystal display panel, and more particularly to a method of driving a liquid crystal display panel that is adaptive for providing the entire panel with a uniform brightness.

2. Discussion of the Related Art

Generally, in a liquid crystal display panel, a liquid crystal layer controls a transmissivity of a light generated from a backlight in accordance with a voltage level of a data signal applied to the liquid crystal layer to display a picture. Such a liquid crystal display panel has a structure in which pixels provided with a liquid crystal layer and pixel electrodes and a reference electrode for applying a driving voltage to the liquid crystal layer and a reference electrode are arranged in a matrix type.

FIG. 1 is a schematic view of a liquid crystal display and a driving apparatus therefor. In FIG. 1, each pixel 22 is provided at each of intersections between m data lines D1 to Dm and n gate lines G1 to Gn within the liquid crystal panel 20. The pixels 22 arranged along each gate line form scanning lines and are connected, via the gate lines G1 to Gn, to a gate driver 24. Also, the pixels 22 are connected, via the data lines D1 to Dm, to the data driver 26. An equivalent circuit of the pixel 22 as a unit picture element is illustrated within an exploded view within the "circle" of FIG. 1. Herein, a liquid crystal layer driven by a voltage difference between the pixel electrode and the reference electrode within a single pixel 22 is equivalent to a liquid crystal capacitor Clc. The pixel electrode is connected to a drain electrode of a thin film transistor (TFT) as a switching device, whereas the reference electrode is connected to a common voltage source Vcom. A gate electrode and a source electrode of the TFT are connected to a gate line and a data line, respectively.

The gate driver 24 sequentially applies a gate driving voltage to each gate line G1 to Gn to drive each scanning line of the panel sequentially. If a voltage is applied, via the gate lines G1 to Gn, to the gate electrodes of the TFT, then a channel is formed between the source electrode and the drain electrode of the TFT. At this time, a data voltage applied from the data driver 24, via the data lines D1 to Dn, to the source electrode of the TFT is applied to the drain electrode of the TFT. A difference voltage between a voltage applied to the drain electrode and a common voltage source Vcom is charged in the liquid crystal capacitor Clc to drive a liquid crystal layer of each pixel 22. Then, the liquid crystal layer controls a transmissivity of a light generated from the backlight in accordance with a difference voltage between the common voltage source Vcom and the data voltage.

In a general color display panel, a mixed ratio of colors three red (R), green (G) and blue (B), is controlled to realize various colors. In the liquid crystal display panel, red (R), green (G) and blue (B) color filers are mounted at each pixel 22 for transmitting a white light, or a color filer is replaced by three backlight lamps for generating red (R), green (G) and blue (B) lights. A driving method of a liquid crystal display panel without color filters is different from that of a liquid crystal display panel with color filters. In a liquid crystal display panel including three color backlight lamps instead of color filters, one frame making a picture is trisected to apply red (R), green (G) and blue (B) color data to the panel sequentially during each frame interval.

FIG. 2 is a timing chart showing an operation process made during one frame interval in a liquid crystal display panel with no conventional color filter. Referring to FIG. 2, in the case of the liquid crystal display panel with no color filter, a data voltage for each of the red (R), green (G) and blue (B) colors applied from the data driver 26 is time-divided during one frame interval to be sequentially charged in the pixels 22 of the panel 20. A backlight lamp having the corresponding color is turned on from a certain time when a data voltage for one color is being charged sequentially for one scanning line within the panel 20, until a time when a data voltage for another color begins to be charged in each ⅓ frame interval.

Herein, to turn on the backlight lamp having the corresponding color before a charge of a data voltage for any one color has been completed aims at lengthening a lamp turn-on time sufficiently to improve the brightness of a picture. If the backlight lamp is turned on before a data voltage for any one color was charged in all of the pixels 22 within the panel 20 as mentioned above, however, there exists a problem in that color purity of a picture displayed on the lower part of the panel 20 is deteriorated. As described earlier, during a time interval when a data voltage is charged in the panel 20, the gate driver 24 drives each gate line G1 to Gn in sequence from the first gate line G1 to the n gate line Gn. In other words, a scanning direction of the panel 20 is set to a direction going from the upper end of the panel to lower end thereof. In the pixels within the scanning line to which a gate voltage is applied, a conductive channel is provided between the source electrode and the drain electrode of the TFT to charge a data voltage applied, via the data driver 24, from the data lines D1 to Dm. Accordingly, if the backlight lamp is turned on before the scanning lines provided at the lower part of the panel 20 have been charged, then color purity of a picture displayed on the pixels at the lower part of the panel 20 is deteriorated because they is in a state of maintaining a data voltage for the preceding color. In order to solve this problem, the liquid crystal display panel with no color filter takes advantages of a scheme of simultaneously resetting all the pixels 22 within the panel 20 before applying a data voltage for any one color, to erase the entire previous data having been charged into each pixel 22 as shown in FIG. 2. If such a scheme is used, then, even though the backlight lamp having the corresponding color is turned on before charging of a data voltage for any one color has been completed, the pixels in which charging of the data voltage for the color has not been made go into a state of erasing the data for the preceding color, so that it is possible to prevent a problem of the color purity deterioration caused by residual data.

In a driving method including the step of sequentially charging a data voltage and the step of simultaneously resetting the pixels 22, however, a brightness non-uniformity phenomenon, differentiating the brightness of a picture displayed on the upper part of the panel 20 from the brightness of a picture displayed on the lower part thereof, is generated. Such a problem will be described in conjunction with FIG. 3 and FIG. 4. In the conventional panel driving method, each gate line G1 to Gn provided within the panel 20 is driven in sequence from the first gate line G1 positioned at the top of the panel, to the nth gate line Gn positioned at the bottom thereof. As shown in FIG. 3, the scanning direction of the panel 20 is always constant for each frame interval. As mentioned above, when all the pixels 22 are simultaneously reset prior to charging the next data, a data sustaining interval until a pixel 22 is to be reset becomes different in accordance with whether the pixel 22 is located at any part of the panel. In other words, since all the pixels 22 are not charged simultaneously, the data-sustaining intervals of the pixels 22 become different for each scanning line at the reset time. For instance, data sustaining intervals between A pixels positioned at the first scanning line of the panel 20, B pixels positioned at the middle scanning line of the panel 20 and C pixels positioned at the nth scanning line at the bottom of the panel 20 as shown in FIG. 1 become different as shown in FIG. 4. A data sustaining interval of the A pixels in which a data voltage is first charged is longest, whereas a data sustaining interval of the C pixels in which a data voltage is last charged is shortest. As described above, the backlight lamp is turned on after a data charge for all the pixels 22 has been completed, but it is turned off after being turned on in the course of a scanning interval of the panel 20 prior to a reset interval of the next pixels 22 so as to improve the brightness. Accordingly, turn-on intervals of the A pixels, the B pixels and the C pixels become different, and a difference in turn-on interval is always generated every frame when a scanning direction of the panel 20 is always constant every frame to cause a brightness difference between the upper part and the lower part of the panel 20.

Such a problem also is generated in the case of driving a liquid crystal display panel with color filters. In a liquid crystal display panel mounted with a color filter for each pixel and including a single backlight lamp, red (R), green (G) and blue (B) data are simultaneously applied every frame as shown in FIG. 5. Also, a scanning direction of the panel 30 is always constant from the upper end of the panel 30 until the lower end thereof. The liquid crystal display panel 30 with color filers provides a data reset interval for each frame so as to prevent a phenomenon of leaving an image from the previous frame onto a residual image when a picture is changed frame by frame to exhibit a slow response speed. The problem related with the residual image is solved by eliminating during the reset interval data which was charged into each pixel in the previous frame. In such a case, the sustaining interval of a data voltage charged into the pixel becomes different in accordance with a position of the pixel within the panel 30 as shown in FIG. 4. Accordingly, since a difference in a data turn-on interval according to a position of the pixel is always generated every frame when a scanning direction of the panel 30 is always constant for each frame, a brightness non-uniformity phenomenon according to a position of the pixel is generated at the panel 30.

SUMMARY OF THE INVENTION

Accordingly, the present invention is directed to method of driving liquid crystal display that substantially obviates one or more of the problems due to limitations and disadvantages of the related art.

An object of the present invention is to provide a method of driving a liquid crystal display panel that is capable of providing the panel with an entirely uniform brightness.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiment of the present invention, examples of which are illustrated in the accompanying drawings.

Figure 2:
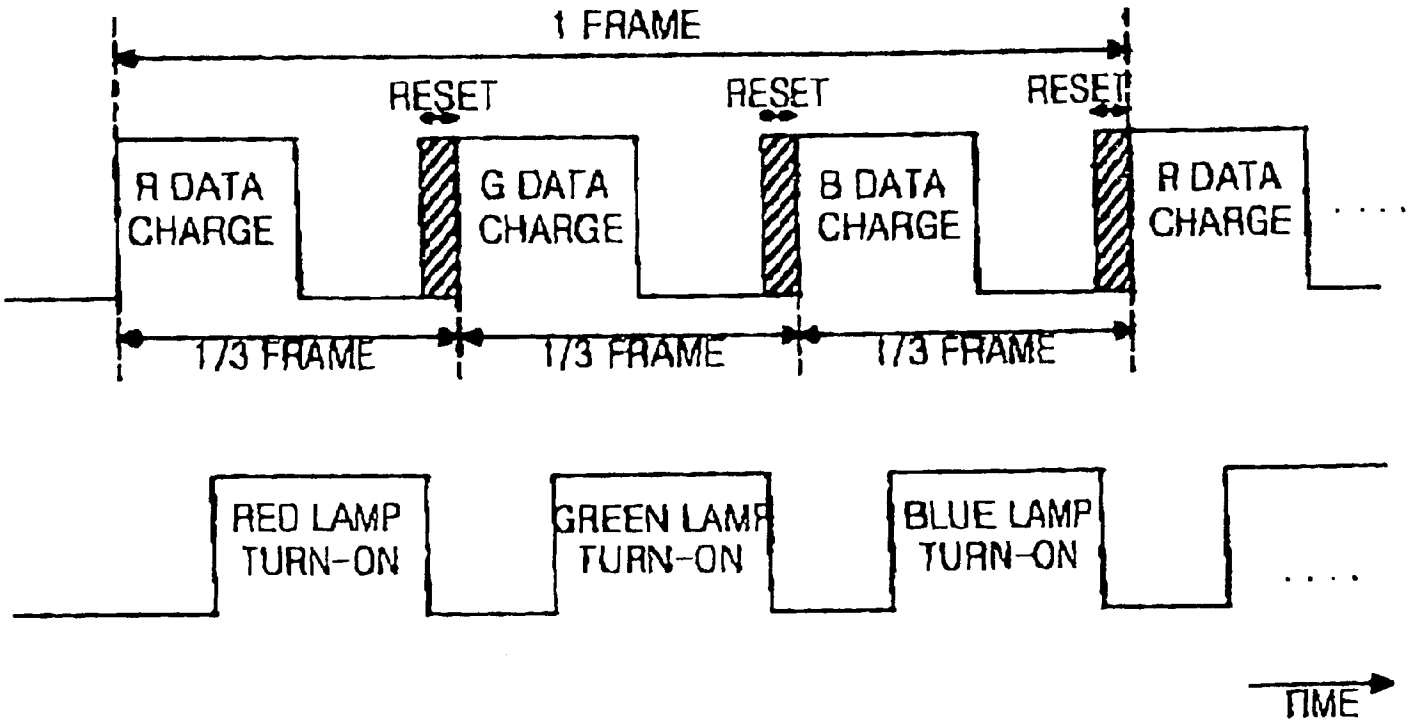
FIG.2 PRIOR ART
FIG. 2 is a timing chart representing an operation process during one frame interval in a liquid crystal display panel with no color filter.
Figure 3:
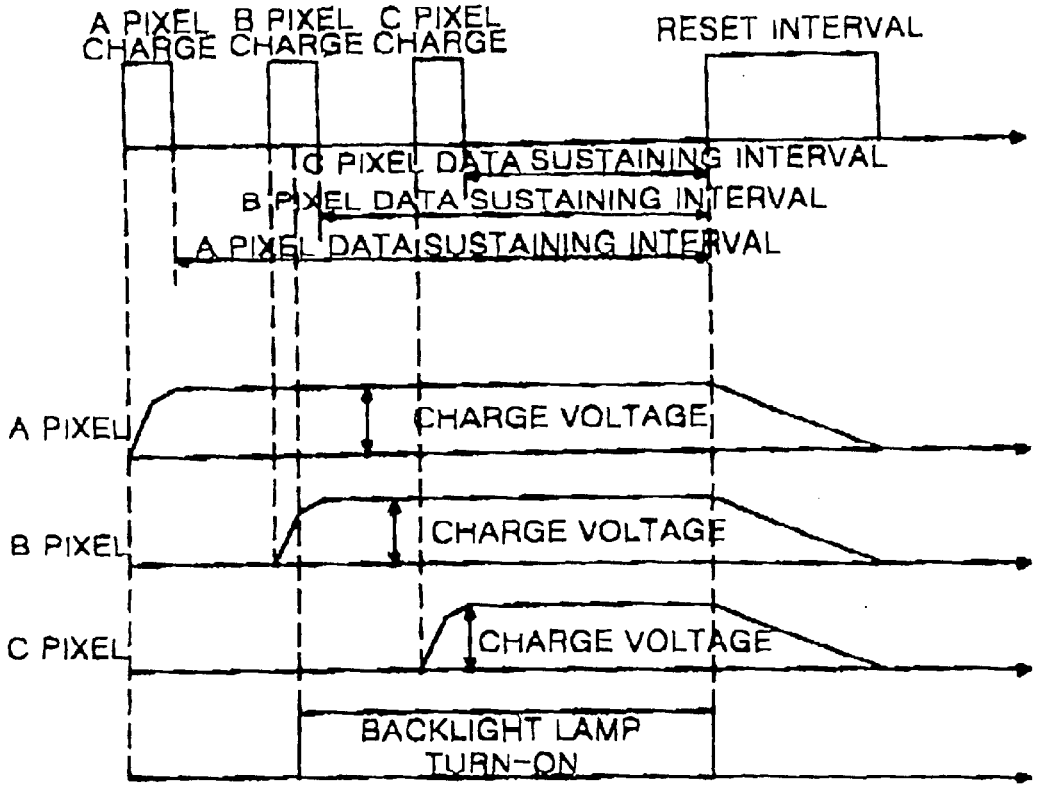
FIG. 3 PRIOR ART
FIG. 3 is a timing chart for explaining a conventional driving method for driving the liquid crystal display panel with no color filter.
Figure 4:
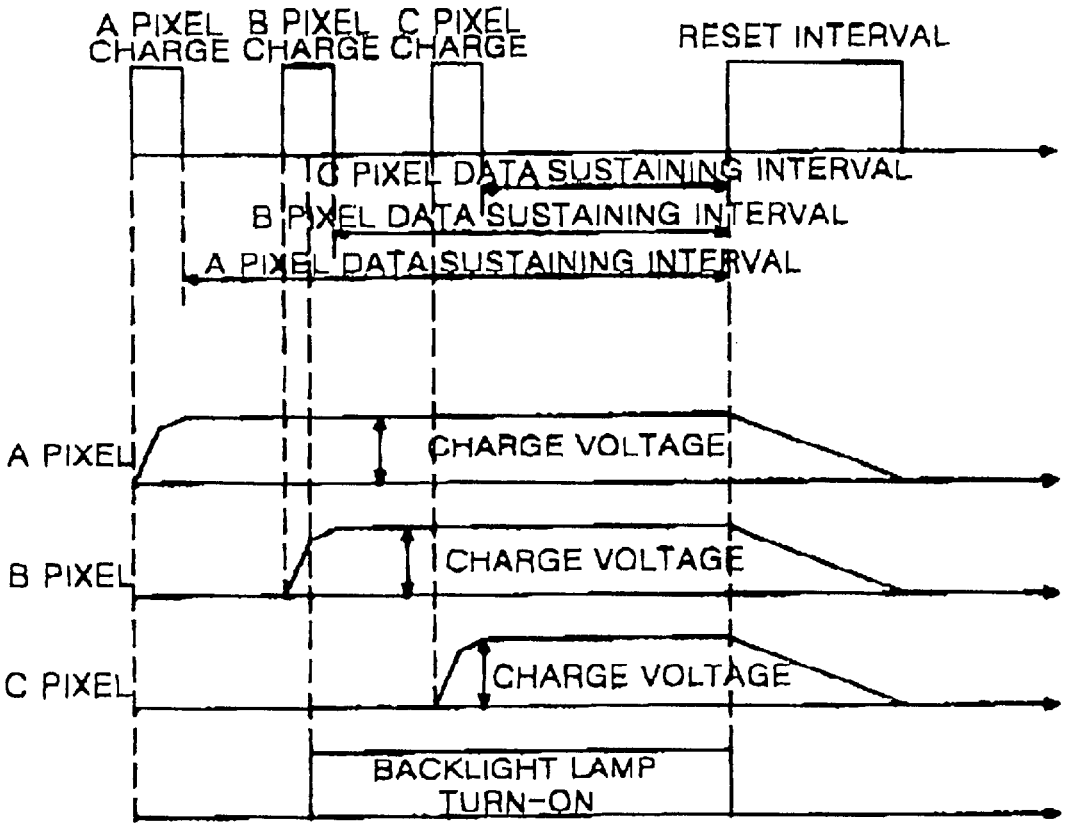
FIG. 4 PRIOR ART
FIG. 4 is a timing chart representing a difference between data sustaining intervals and turn-on intervals among A, B and C pixel cells shown in FIG. 1 when the liquid crystal display panel is driven as shown in FIG. 3.
Figure 5:
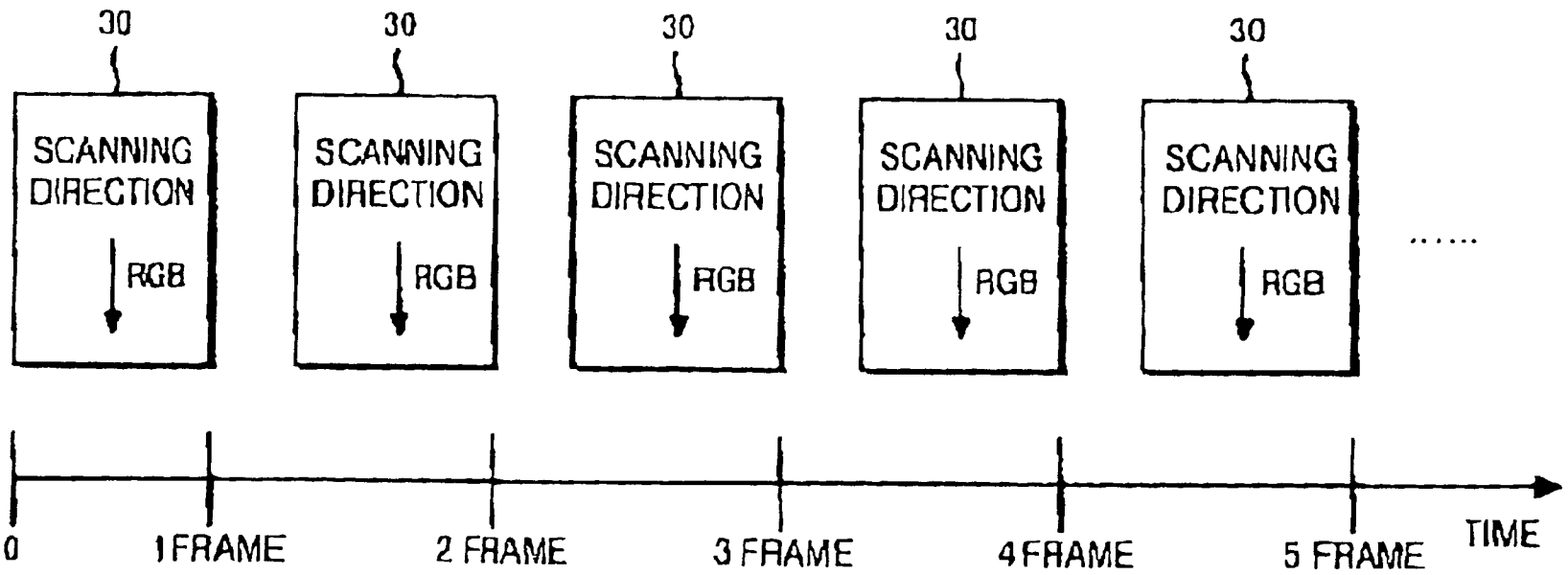
FIG. 5 PRIOR ART
FIG. 5 is a view for explaining the conventional driving method for driving a liquid crystal display panel with color filters.
Figure 6:
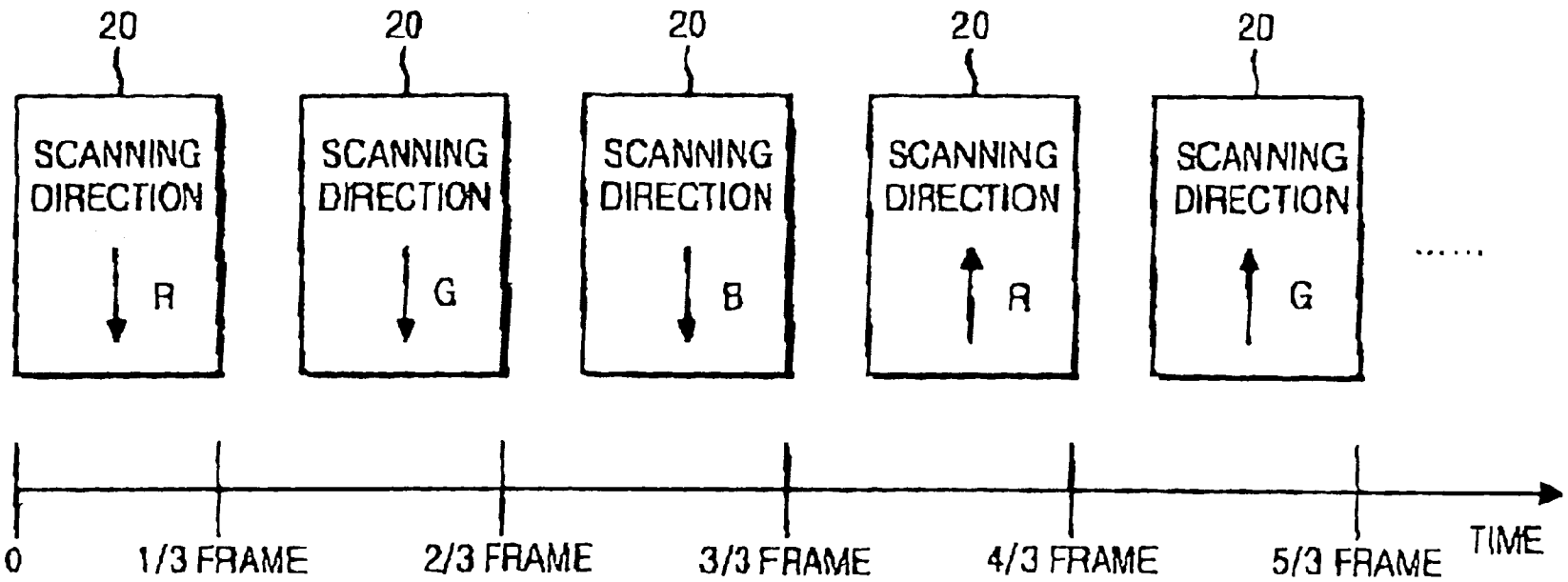
FIG. 6 is a view for explaining a driving method of a liquid crystal display panel with no color filter according to a first embodiment.

FIG. 6 represents a method of driving a liquid crystal display panel according to a first embodiment, which is related to a driving method of a liquid crystal display panel driven by a color sequential driving system without color filters. In the case of driving a liquid crystal display panel with no color filter, one frame is time-divided to sequentially charge each data voltage corresponding to each of red (R), green (G) and blue (B) colors. A backlight lamp having the corresponding color is turned on from any one time in a time interval when a data voltage related to any one color is charged in each pixel within the panel 20 until a time when a data voltage related to the next color begins to be charged as shown in FIG. 2 in order to improve the brightness. Also, in order to improve the color purity, all the pixels within the panel 20 are simultaneously reset prior to charging of the next data to erase the entire previous data having been maintained in each pixel.

In a preferred embodiment driving method as disclosed herein, a scanning direction of the panel 20 is inverted every frame in an interval when a data voltage is charged in each pixel. More specifically, a sequential scanning beginning with the first scanning line of the panel 20 and going toward the lower end of the panel 20 is made during the odd-numbered frames, whereas a sequential scanning beginning with the nth scanning line of the panel 20 and going toward the upper end of the panel 20 is made during the even-numbered frames. To this end, in a liquid crystal display device shown in FIG. 1, when the gate driver 24 applies a gate line "ON" signal to each gate line G1 to Gn of the liquid crystal display panel 20, an application of the gate line "ON" signal begins with the first gate line G1 and terminates with the nth gate line Gn during the odd-numbered frames. On the other hand, an application of the gate line "ON" signal begins with the nth gate line Gn and terminates with the first gate line G1 during the even-numbered frames.

Figure 1:
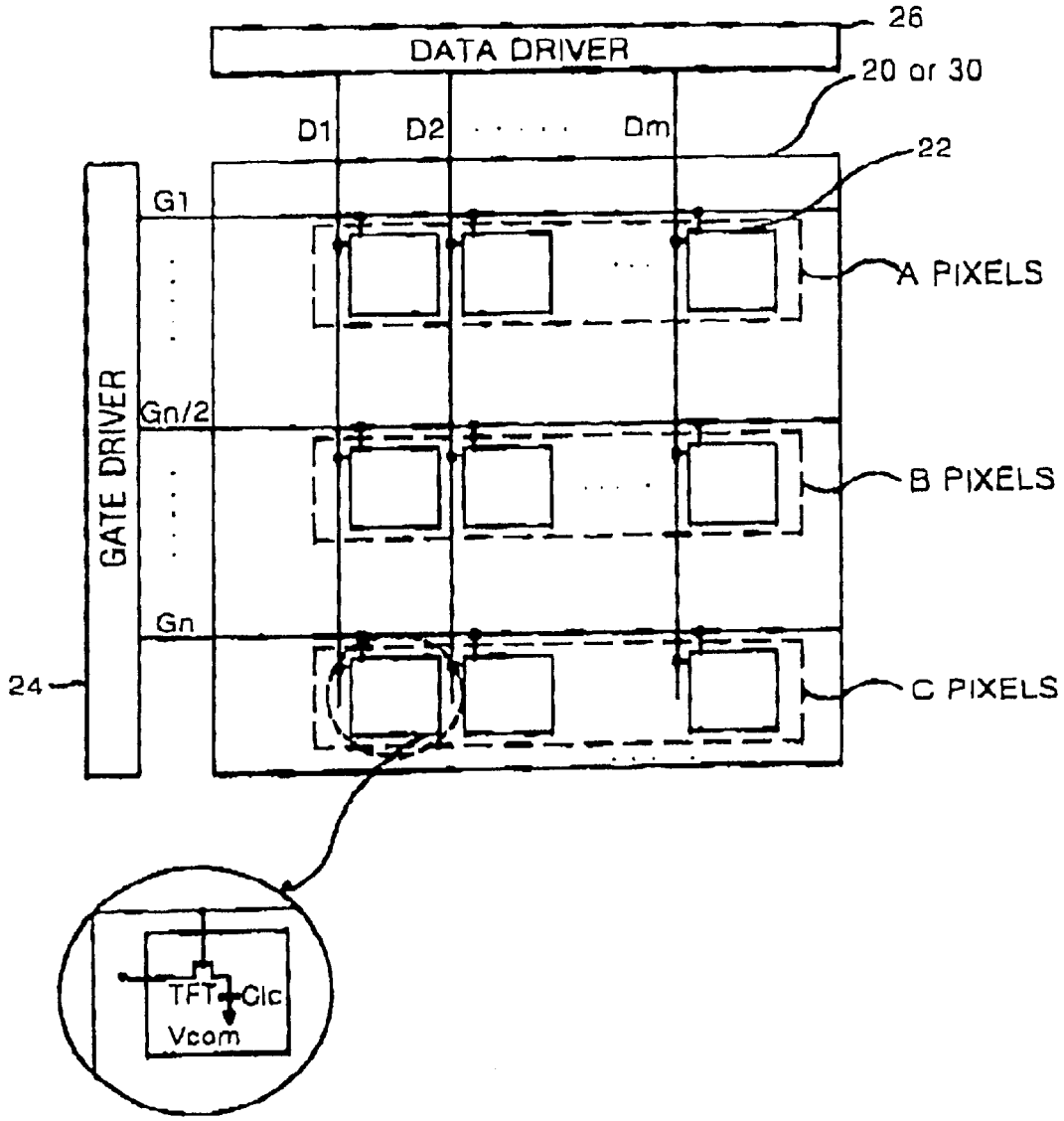
FIG. 1 PRIOR ART
FIG. 1 is a schematic view showing the configuration of a liquid crystal display panel and a driving apparatus thereof.
Figure 7:
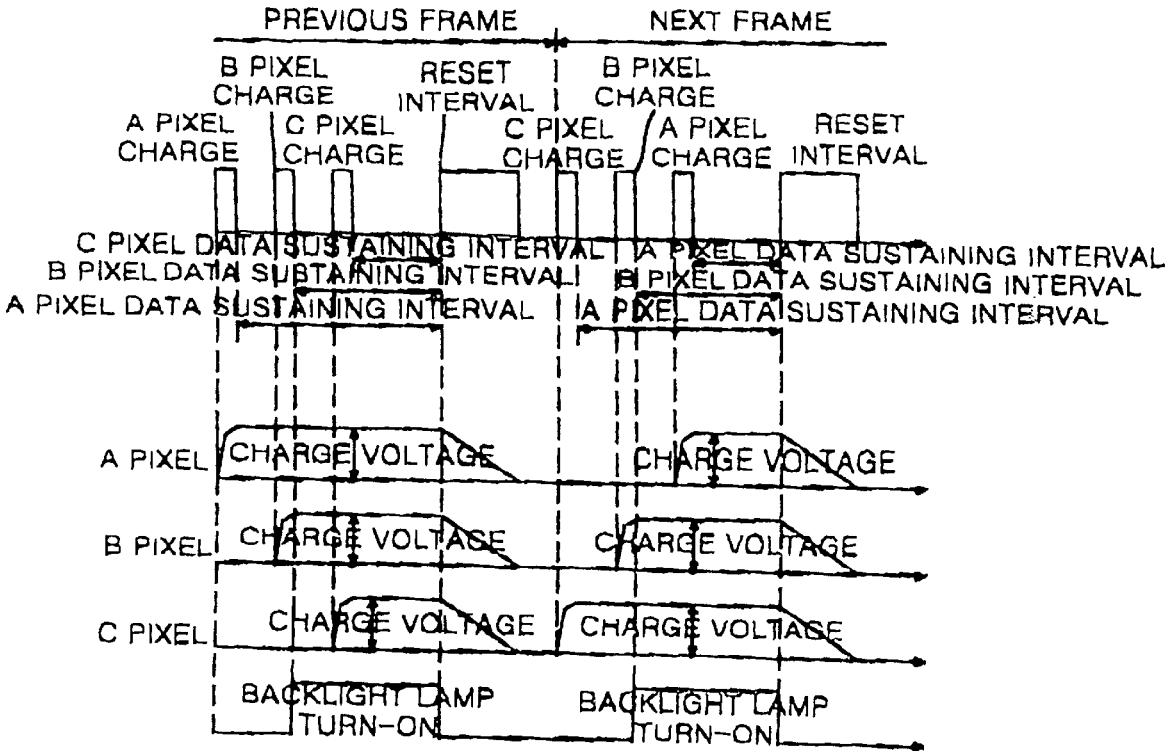
FIG. 7 is a timing chart representing a change in a data sustaining interval and a turn-on interval for each of the A, B and C pixel cells shown in FIG. 1 when the liquid crystal display panel is driven as shown in FIG. 6.

As shown in FIG. 7, if the panel 20 is driven in this manner, then data sustaining intervals and turn-on intervals of the A pixels, the B pixels and the C pixels within the liquid crystal display panel 20 shown in FIG. 1 become different every frame. FIG. 7 is a timing chart illustrating a change in the data sustaining interval and the turn-on interval for each of the A, B and C pixels shown in FIG. 1 when a scanning direction of the panel 20 is inverted every frame. Referring to FIG. 7, in a frame interval when the scanning direction of the panel 20 is set to go from the upper end of the panel 20 to the lower end thereof, the data sustaining interval and the turn-on interval of the A pixels provided at the first scanning line are longest, while the data sustaining interval and the turn-on interval of the C pixels provided at the nth scanning line are shortest. On the other hand, in the next frame interval when the scanning direction of the panel 20 is set to go from the lower end of the panel 20 to the upper end thereof, the data sustaining interval and the turn-on interval of the C pixels are longest, while those of the A pixels are shortest. Accordingly, a difference in the data sustaining interval and the turn-on interval among the A, B and C pixels generated during any one frame interval is compensated in the next frame interval. As a result, the average turn-on intervals of the A, B and C pixels provided at different positions on the panel 20 are equalized by the process of inverting the scanning direction of the panel 20 for each frame, so that the brightness of the entire panel 20 can be uniform.

Figure 8:
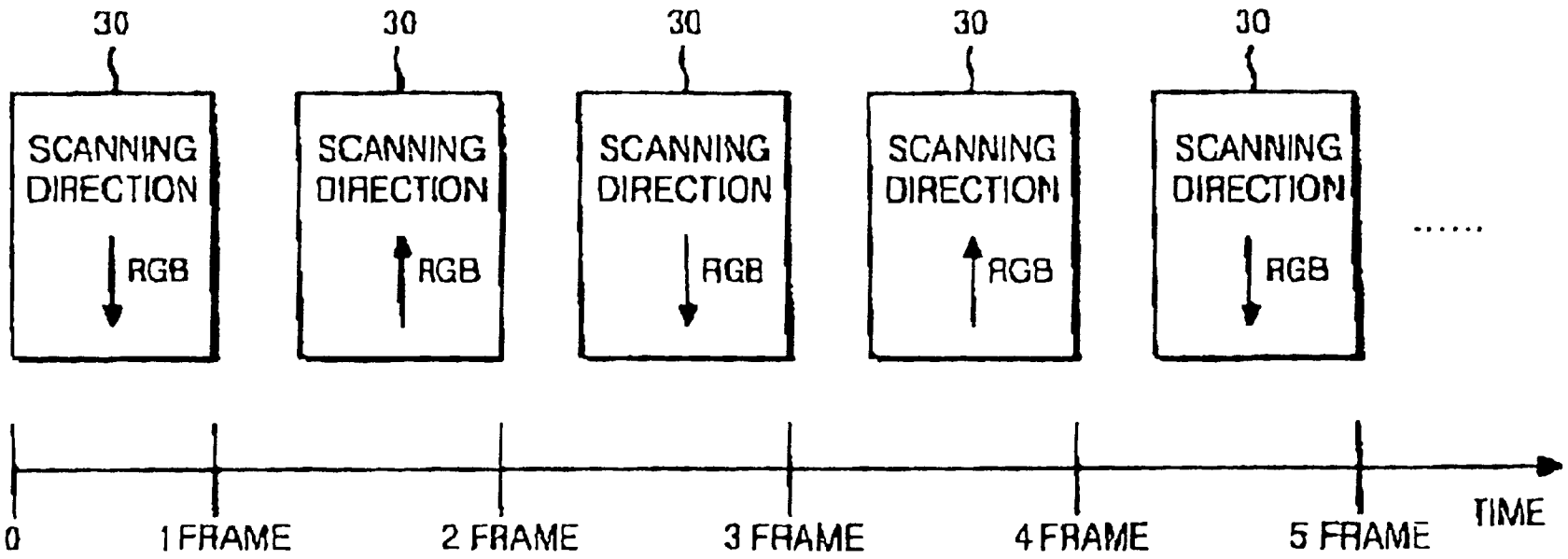
FIG. 8 is a view for explaining a driving method of a liquid crystal display panel with color filters according to a first embodiment.

FIG. 8 represents a method of driving a liquid crystal display panel according to a second embodiment, which has been applied to a liquid crystal display panel with color filters. Referring now to FIG. 8, in a driving method of a liquid crystal panel with color filters, red (R), green (G) and blue (B) data voltage are simultaneously charged during one frame interval as mentioned above. Also, all the data stored in each pixel within the panel 30 at the earlier frames are erased in the reset interval just prior to the beginning of a new frame so as to eliminate the residual image effect. In the driving method according to the second embodiment for driving the liquid crystal display panel 30 with color filters, the scanning direction of the panel 30 is inverted every frame in similarity to the driving method according to the first embodiment. More specifically, during the odd-numbered frames, a sequential scanning beginning with the first scanning line at the upper end of the panel 30 and going toward the lower end of the panel 30 is made to simultaneously charge the red (R), green (G) and blue (B) data voltages in one frame interval. On the other hand, during the even-numbered frames, a sequential scanning beginning with the nth scanning line at the lower end of the panel 30 and going toward the upper end of the panel 30 is made to simultaneously charge each of the red (R), green (G) and blue (B) data voltages. In a frame interval when the scanning direction of the panel 30 is set to go from the upper end of the panel 30 to the lower end thereof, the data sustaining interval and the turn-on interval of the A pixels provided at the first scanning line of the liquid crystal display panel 30 in FIG. 1 are longest while the data sustaining interval and the turn-on interval of the C pixels provided at the nth scanning line are shortest. On the other hand, in the next frame interval when the scanning direction of the panel 30 is set to go from the lower end of the panel 30 into the upper end thereof, the data sustaining interval and the turn-on interval of the C pixels are longest while those of the A pixels are shortest. Accordingly, a difference in the data sustaining interval and the turn-on interval among the A, B and C pixels generated during any one frame interval is compensated for in the next frame interval. As a result, the average turn-on intervals of the A, B and C pixels provided at a different position on the panel 30 are equalized by the process of inverting the scanning direction of the panel 30 for each frame, so that the brightness of the entire panel 30 can be uniform.

As described above, the scanning direction is inverted every frame. Thus, a turn-on interval difference generated between the upper part and the lower part of the panel in any one frame interval is compensated in the next frame interval. Accordingly, an average turn-on interval of all the pixels is equalized, so that the brightness of the entire panel can be uniform.

It will be apparent to those skilled in the art that various modifications and variation can be made in the present invention without departing from the spirit or scope of the invention. Thus, it is intended that the present invention cover the modifications and variations of this invention within the scope of the appended claims and their equivalents.

What is claimed is:

1. A method of driving a liquid crystal display panel, comprising the steps of:

scanning the panel in a first direction within a desired period and turning on a backlight lamp to charge data into pixels forming picture elements of the panel;

simultaneously resetting the pixels charged with the data; and scanning direction of scanning the panel in a second direction opposed to the first direction within a next desired period and turning on the backlight lamp to charge next data into the pixels, such that an average turn-on time among the pixels is substantially equal.

2. The method as claimed in claim 1, wherein the desired period is a frame.

3. The method as claimed in claim 1, wherein red, green and blue data are each sequentially charged in one frame interval.

4. The method as claimed in claim 1, wherein red, green and blue data are simultaneously charged in one frame interval.

5. A method of driving a liquid crystal display device having a plurality of pixels disposed in a matrix of rows and columns, the method comprising:

in a first time period, sequentially scanning the rows of pixels in the liquid crystal display device, beginning with a first row and ending with a last row, and turning on a backlight lamp to charge data into the pixels; and in a second time period, sequentially scanning the rows of pixels in the liquid crystal display device, beginning with the last row and ending with the first row, and turning on the backlight lamp to charge next data into the pixels, such that an average turn-on time among the pixels is substantially equal, and simultaneously resetting all of the pixels of the liquid crystal display device between the first time period and the second time period.

6. The method of claim 5, wherein the liquid crystal display device displays a plurality of colors during each of the first time period and the second time period.

7. The method of claim 6, wherein the plurality of colors comprise red, green, and blue colors.

8. The method of claim 5, wherein the first time period comprises a first frame and the second time period comprises a second frame immediately following the first frame.

9. The method of claim 8, wherein the liquid crystal display device displays a plurality of colors during each of the first frame and the second frame.

10. The method of claim 9, wherein the plurality of colors comprise red, green, and blue colors.

11. The method of claim 5, wherein the liquid crystal display device displays only a first color during the first time period, and displays only a second color during the second time period.

12. The method of claim 5, further comprising in a third time period, sequentially scanning the rows of pixels in the liquid crystal display device, beginning with the first row and ending with the last row.

13. A liquid crystal display panel, comprising:

a plurality of pixels, arranged along rows and columns of a matrix;

a backlight lamp for illuminating the pixels;

a plurality of data lines disposed along said columns and connected to said pixels;

a data driver connected to said columns for supplying data to said pixels;

a plurality of gate lines disposed along said rows and connected to said pixels; and a gate driver for, in a first time period, sequentially scanning the rows of pixels in the liquid crystal display device, beginning with a first row and ending with a last row; and in a second time period, sequentially scanning rows of pixels in the liquid crystal display device, beginning with the last row and ending with the first row, such that an average turn-on time of the backlight lamp among the pixels is substantially equal, wherein all of the pixels of the liquid crystal display device are simultaneously reset between the first time period and the second time period.

14. A method of driving a liquid crystal display panel, comprising:

charging data into pixels forming picture elements of the panel in a scanning direction, wherein each of the pixels has a thin film transistor;

simultaneously resetting the pixels charged with the data, wherein the resetting further includes turning on the thin film transistor of the pixels and then applying a constant voltage to the pixels; and inverting the scanning direction of the panel within a desired period.

* * * * *